US007469563B2

(12) United States Patent
Wahlgren et al.

(10) Patent No.: US 7,469,563 B2
(45) Date of Patent: Dec. 30, 2008

(54) INSULATING SLEEVE WITH WIRE MESH AND WIRE CLOTH

(75) Inventors: George Wahlgren, Piscataway, NJ (US); Roberto Seijas, Glen Gardner, NJ (US); Kurry Emmons, Neshanic Station, NJ (US)

(73) Assignee: Metal Textiles Corporation, Edison, NJ (US)

( * ) Notice: Subject to any disclaimer, the term of this patent is extended or adjusted under 35 U.S.C. 154(b) by 49 days.

(21) Appl. No.: 11/736,801

(22) Filed: Apr. 18, 2007

(65) Prior Publication Data

US 2007/0261914 A1 Nov. 15, 2007

Related U.S. Application Data

(60) Provisional application No. 60/746,895, filed on May 10, 2006.

(51) Int. Cl.
*D04B 21/14* (2006.01)

(52) U.S. Cl. ..... 66/169 R

(58) Field of Classification Search ..... 66/169 R, 66/170, 182, 202, 196, 197
See application file for complete search history.

(56) References Cited

U.S. PATENT DOCUMENTS

| | | | | |
|---|---|---|---|---|
| 3,948,295 | A * | 4/1976 | Lemont et al. | 138/147 |
| 3,949,828 | A | 4/1976 | Frochaux | |
| 4,278,717 | A | 7/1981 | Aoyama | |
| 4,931,326 | A * | 6/1990 | Weil | 428/35.8 |
| 5,617,900 | A * | 4/1997 | Weil | 138/127 |
| 5,799,395 | A | 9/1998 | Nording et al. | |
| 5,965,223 | A * | 10/1999 | Andrews et al. | 428/34.5 |
| 6,887,543 | B1 * | 5/2005 | Louart et al. | 428/36.9 |
| 6,978,643 | B2 | 12/2005 | Akers et al. | |
| 7,364,587 | B2 * | 4/2008 | Dong et al. | 623/1.5 |
| 7,402,174 | B2 * | 7/2008 | Dong | 623/1.5 |
| 2003/0019688 | A1 | 1/2003 | Takewaka et al. | |

FOREIGN PATENT DOCUMENTS

| | | |
|---|---|---|
| EP | 1048827 | 11/2000 |
| GB | 2256006 | 11/1992 |

OTHER PUBLICATIONS

Search report and written opinion.

* cited by examiner

*Primary Examiner*—Danny Worrell
(74) *Attorney, Agent, or Firm*—Carella, Byrne et al.; John G. Gilfillan, III; William Squire

(57) ABSTRACT

A tubular sound/heat insulating tubular structure which may serve as a muffler packing for internal combustion engine exhaust mufflers comprises in one embodiment an inner layer of solely stainless steel wire mesh formed into a continuous length tube. An intermediate structure in that embodiment comprises a flattened tubular structure which is wrapped into two overlying layers of coknitted basalt or other continuous length non-metallic fibers and preferably stainless steel wire. The flattened juxtaposed layers are wrapped about the inner layer at least once by feeding both structures through a cone and forming at least two or more layers of coknitted wire mesh and basalt fibers. In this embodiment, an outer layer of solely stainless steel wire mesh is then knitted about the overlying concentric tubular structures fed from the cone into and through a knitting machine. The continuous length of overlying concentric tubes are then sized by pulling through dies to form and shape the inner and outer diameters and then cut to length.

23 Claims, 7 Drawing Sheets

INSULATING SLEEVE WITH WIRE MESH AND WIRE CLOTH

The is application claims the benefit of provisional application Ser. No. 60/746,895 filed May 10, 2006, incorporated in its entirety by reference herein.

FIELD OF INVENTION

This invention relates to sleeves used for example as a muffler packing for internal combustion engines to dampen the exhaust sound and/or to provide heat and/or sound insulation to a conduit or the like.

BACKGROUND OF THE INVENTION

Mufflers for internal combustion engines may employ packing materials to attenuate noise exiting the exhaust system. These materials tend to comprise short fibers that are mechanically pressed into blankets or blown into a cavity. The problem is that the short fibers tend to break free in service and are expelled from the muffler. This significantly reduces the amount of fibers left in the muffler and thus reduces the noise attenuation properties of the muffler.

U.S. Pat. No. 6,978,643 to Akers et al. discloses multilayer sleeves for insulation for protecting elongated substrates. This structure is not disclosed as being useful as a muffler packing for internal combustion engine mufflers. The sleeves are continuously knitted in different sections integrally joined end to end, the sections being formed of different filamentary members chosen for desired characteristics. The sleeves are formed into the multilayer configuration by reverse folding the sleeves inwardly to place one section concentric within another. The sleeve ends may be finished with welts to prevent raveling and serve as a clinch on the elongated substrates. Rib knits are used to form insulating air pockets lengthwise along the sleeves to augment the insulating effectiveness.

The sleeve comprises a first flexible tubular segment formed from interlaced base filamentary members such as metal wire and fiber filaments by knitting. A second flexible tubular segment is formed of interlaced filamentary members also of base wire filaments interlaced with fibers. The inner segment is formed from glass, quartz or other mineral fibers that are resistant to high temperatures.

The first and second segments are each folded circumferentially inward to form the first and second segments each into two coaxial segments. The outer segment is formed of DREF fiber yarns and glass fibers are used to form the inner segment to permit manual handling of the outer segment without harshness as exhibited by glass fibers. The interlaced filaments have different characteristics. The base filamentary members of each segment may be wires and the interlaced filamentary members of each segment are fibers. This structure requires all of the segments to comprise a base wire filament knitted with a second fiber filament and also requires the fibers of the outer segments to be DREF and the inner segments to be glass fibers for handling purposes.

This construction is relatively complex and costly in that both wires and fibers are required throughout the various outer and inner segments. Also it requires additional costly folding steps to reversely fold the various segments to form coaxial related segments.

U.S. Pat. No. 4,278,717 to Aoyama is not disclosed as useful as a packing for use with internal combustion engine mufflers and discloses a heat resistant cushion in the form of a compact toroidal structure which is formed by an annular network of knitted metal wires. The network includes a first segment which forms an outer surface of the toroidal structure and a second inner segment containing yarns of an inorganic fiber which disposed at a given axial separation and extend circumferentially of the network. The fibers are supported by engagement with selected loops of metal wires, such as every third course of knitted wires, which forms the second segment. The network structure is rolled upon itself beginning with the free end of the second segment to form a toroidal structure.

U.S. Pat. No. 3,949,828 to Frochaux discloses a fluid exhaust silencer comprising a hollow cylindrical fluid permeable noise-reducing element made of wire mesh. The noise reducing element is mounted in a housing which is adapted to be connected to an exhaust for a pressurized fluid. The housing is made so that the pressurized fluid flows into one end of the housing and is discharged from the side of the housing after passage through the noise reducing element. However, this structure is not disclosed as useful with present internal combustion engine exhaust mufflers.

U.S. Pat. No. 5,799,395 to Nording et al. discloses a process for manufacturing an air gap insulated exhaust pipe. An air gap insulated exhaust pipe has a sliding fit between two inner pipe sections in a middle area of the length of the exhaust pipe and has a radial mounting to the inner pipe in the outer pipe which is provided in the area of a bend or beyond the bend, which joins the leg of the exhaust pipe in which the sliding fit is located. This structure is not disclosed as useful for correcting an internal combustion engine muffler loose packing problem discussed above.

The present inventors recognize a need for a solution to the above problem with present muffler packings. In particular, they recognize a need for a sleeve for sound/heat insulation for tubular members especially one that can be for used as a packing for exhaust mufflers of internal combustion engines to preclude loss of the fibers as presently occurs or for use with other high temperature or noisy tubular members or applications and is low cost to fabricate and easily manufactured. The prior art systems described above are believed to be costly to make or believed to not adequately serve as muffler packing for internal combustion engine exhaust systems by way of example.

SUMMARY OF THE INVENTION

A sleeve for sound/heat insulation for tubular members, for example, as a muffler packing, according to one embodiment of the present invention, and which may be used as a packing in an internal combustion engine muffler to minimize loss of noise attenuation as in present muffler packings employing short fibers, comprises a knitted wire mesh outer layer comprising solely knitted wire; a knitted wire mesh inner layer comprising solely knitted wire; and at least one intermediate layer between the outer and inner layers comprising knitted wire coknitted with at least one continuous fiber.

The continuous fiber thus avoids the problem with prior art short fibers being discharged from the mufflers during use, for example, and at the same time provides good noise attenuation that is reliable and exhibits a long life as compared to prior art packings.

In one embodiment, the intermediate layer comprises at least two overlying layers of the knitted wire coknitted with the at least one continuous fiber, wherein, In a further embodiment, the fiber is basalt.

In a further embodiment, the inner layer preferably comprises stainless steel wire in the range of about 0.011 to about 0.028 inches in diameter, and in a further embodiment, the outer layer comprises stainless steel wire in the range of about 0.006 to about 0.020 inches in diameter, and in a still further embodiment, the intermediate layer comprises stainless steel wire in the range of about 0.003 to about 0.011 inches in diameter.

In a further embodiment, the basalt fibers have a diameter of about 5 to 20 microns and also preferably the fibers are assembled in a roving of about 330 +/−10% bundle tex.

In a further embodiment, the inner layer is tubular with an inner diameter of about 1 to 4 inches.

In a further embodiment, the at least one continuous fiber is non-metallic yarn which is resistant to relatively high temperatures of over about 500° C.

In a still further embodiment, the knitted wire is preferably stainless steel and the wires of the outer and inner layers are of different diameters.

In a further embodiment, a method of making a continuous sound/heat insulating tubular structure, especially for use as a muffler packing for exhaust systems for internal combustion engines, for example, comprises knitting a first cylindrical tubular wire mesh layer structure from metal wire, knitting a second cylindrical tubular wire mesh layer structure with metal wire coknitted with at least one continuous non-metallic fiber, flattening the second cylindrical tubular structure to form a planar coknitted metal wire structure with at least one continuous non-metallic fiber, wrapping the flattened second structure about the first cylindrical structure to form a composite multilayered tubular structure and then knitting from metal wire a third outermost tubular layer about the composite multilayered tubular structure to form a continuous multiple layer tubular structure wherein the wrapped flattened second structure is intermediate the first and third layers.

In a further embodiment, all of the knitted wire is stainless steel and the at least one fiber is basalt.

In a further embodiment, the wrapping step includes feeding the first tubular structure and flattened second structure into a cone with the flattened second structure wrapped about the first structure during the feeding into the cone.

In a further embodiment, the method includes feeding the continuous resulting multiple layer tubular structure into a series of dies to reshape and reform the internal diameter of the inner most tubular structure and reform the outer diameter of the outermost tubular structure.

In a further embodiment, the method further includes forming the second structure into at least two flattened layers and then wrapping the second structure at least once about the inner tubular structure to form at least a three layer structure such that the knitted outer layer forms the sound/heat insulating tubular structure into at least a four layer structure.

In a further embodiment, a muffler sleeve which is used for example in an exhaust system for an internal combustion engine muffler packing and provides sound or heat insulation for the muffler, for example, comprises a knitted wire mesh outer tubular layer comprising solely knitted wire and a knitted wire mesh inner tubular layer which comprises solely knitted wire. An intermediate tubular layer is between the outer and inner layers comprising knitted metal wire coknitted with at least one continuous non-metallic fiber to form a composite knitted wire mesh-knitted non-metallic fiber layer. Preferably the coknitted layer is formed into at least two overlying contiguous layers disposed between the inner and outer layers.

IN THE DRAWING

Figure 1:
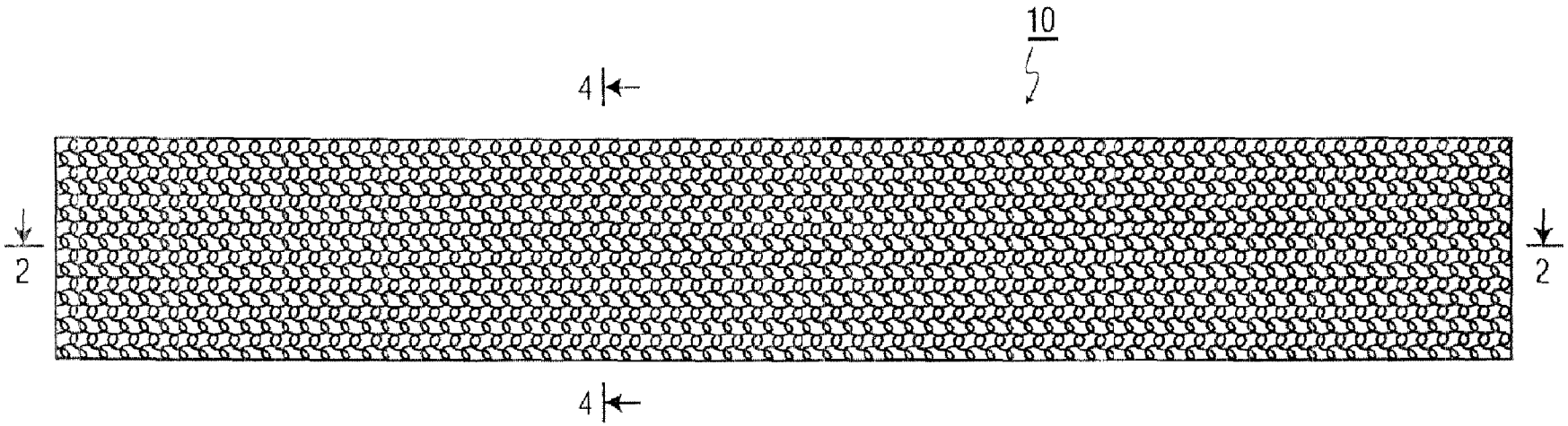
FIG. 1 is an elevation view of a tubular structure according to an embodiment of the present invention.
Figure 8:
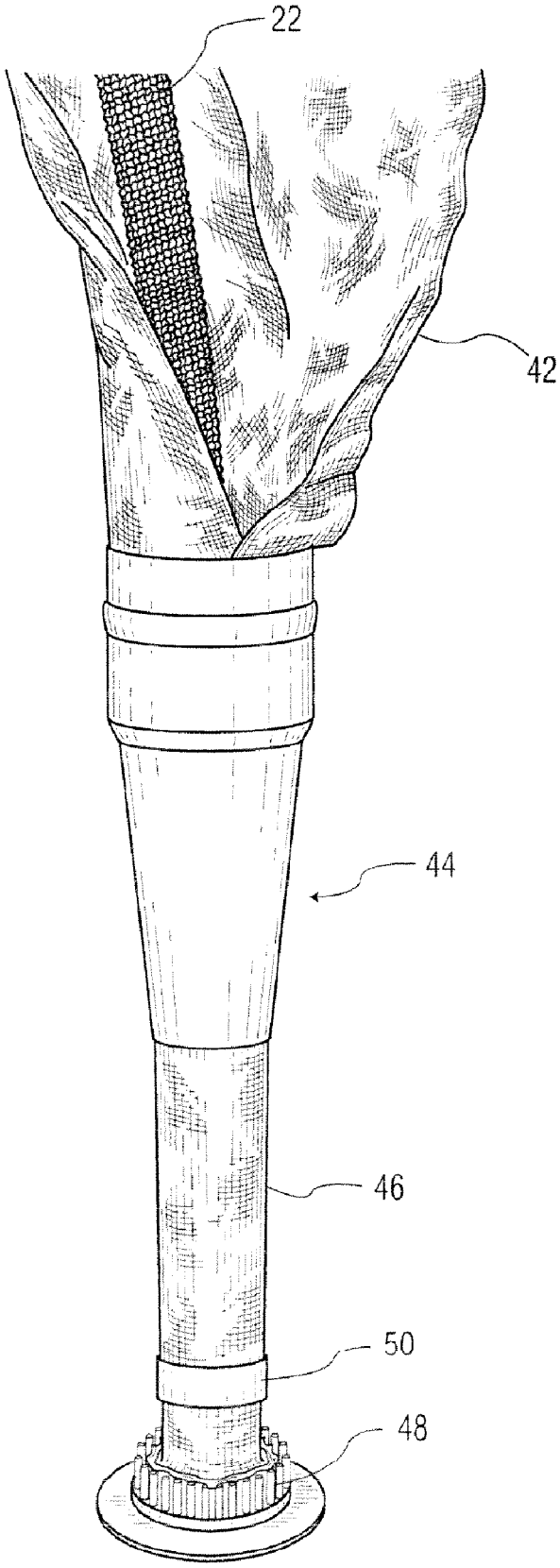

FIG. *7a* is a side elevation view of an intermediate layer after folding over juxtaposed with one another to form a two layer structure of coknitted substantially continuous length fibers and wire; and FIG. 8 is an elevation perspective view of an apparatus utilized in the process for forming the structure of the embodiment of FIG. 1.

DETAILED DESCRIPTION OF THE PREFERRED EMBODIMENTS

In FIG. 1, sleeve 10 is an elongated tubular structure comprising multiple layers which form for example in this embodiment, a muffler packing for an internal combustion engine exhaust system (not shown). The length of the sleeve 10 is determined by a given implementation so that it corresponds in length to the muffler to which it is to be attached. It fits over a perforated exhaust pipe (not shown) and is concentric with the pipe.

Figure 2:
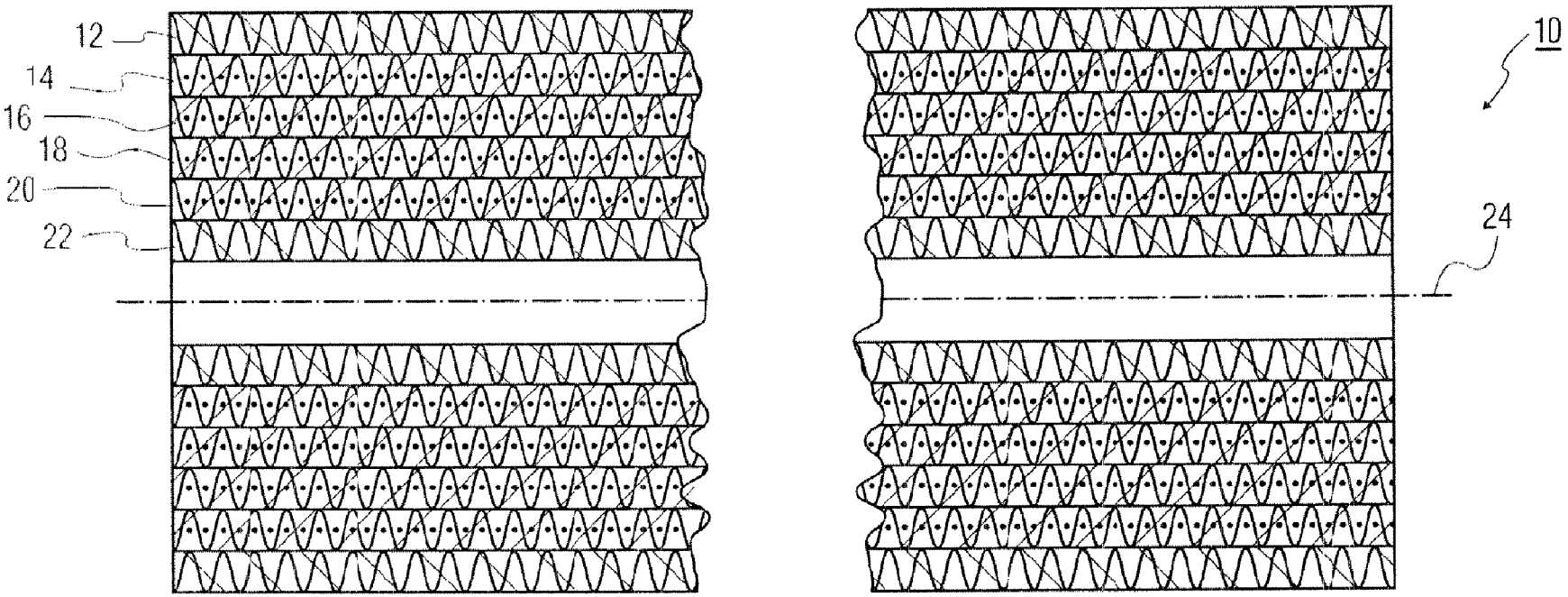
FIG. 2 is a sectional fragmented view of the structure of FIG. 1 taken along lines 2-2.
Figure 4:
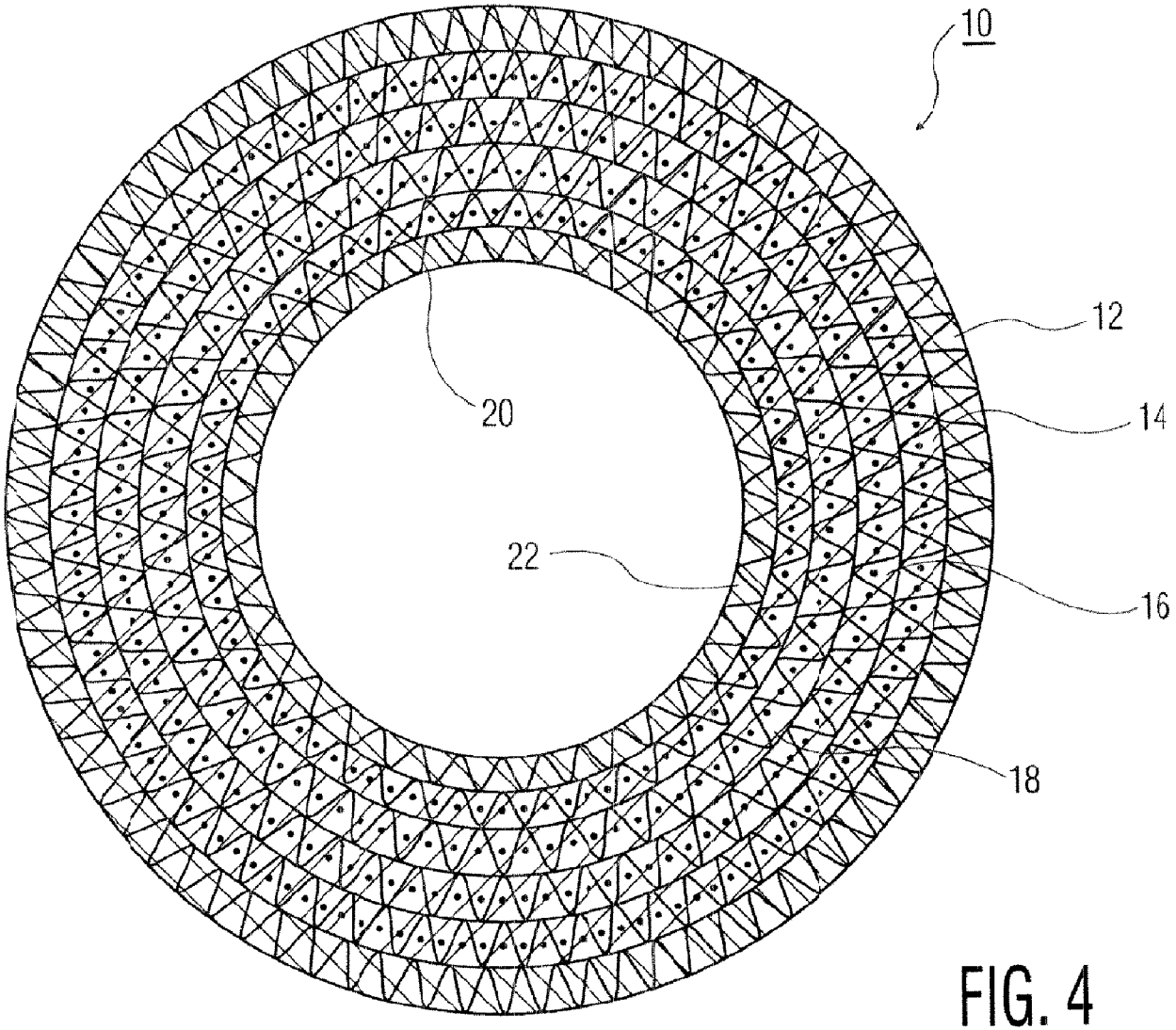
FIG. 4 is a sectional view of the structure of FIG. 1 taken along lines 4-4.
Figure 5:
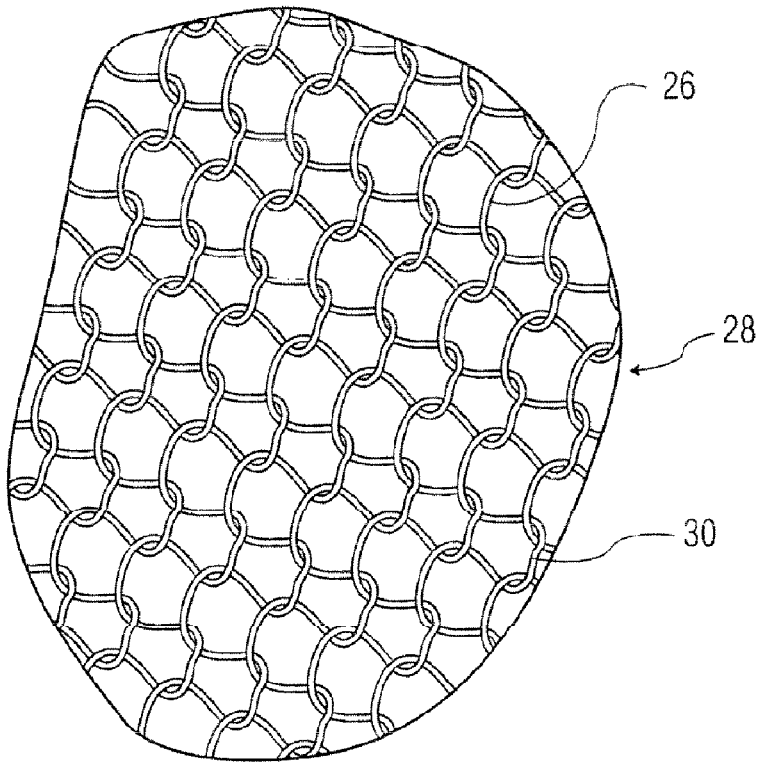
FIG. 5 is a plan view of a portion of the wire knit mesh material forming the outermost layer of the structure of FIG. 1.

In FIGS. 2 and 4, the sleeve 10 comprises multiple concentric tubular layers 12, 14, 16, 18, 20 and 22 which are concentric with longitudinal axis 24. Layer 12 is the outermost layer and layer 22 is the inner most layer. Layer 12 comprises solely knitted wire mesh. Layer 22 comprises knitted wire mesh or woven wire cloth. FIG. 5 illustrates the outer layer 12' for example as it appears in a top plan, but flattened view. The outer layer 12 in one embodiment comprises stainless steel wire 26 which is knitted on a conventional knitting machine into a wire mesh 28. The wire 26 is knitted into interlocking loops 30. The wire of layer 12 in this embodiment has a diameter of about 0.006 inches to about 0.020 inches (0.152 mm to 0.5 mm). However, this diameter may differ from these values in other embodiments according to a given implementation. The outer layer 12 forms a semi-rigid tube to contain the intermediate layers and keep the fibers of the intermediate layers from breaking loose from the sleeve.

The innermost layer 22, FIG. 2, appears similar to outer layer 12' in knitted wire mesh configuration, but is knitted preferably from stainless steel wire having a diameter of about 0.011 inches to about 0.028 inches (0.28 mm to 0.71 mm). This tube, which may be, in one embodiment, endless, except for practical purposes, it is cut into sections. The inner layer 22 is cylindrical and is semi-rigid to support the intermediate layers to be described below. The tubular structure forming the inner layer 22 is knitted on a circular knitting machine. The tubular structure is then pulled through a series of dies (not shown) to reshape and form the outer diameter of the structure. The continuous length of tube is flexible and stored for later use for assembly of the structure forming the sleeve 10, FIG. 1.

Figure 7:
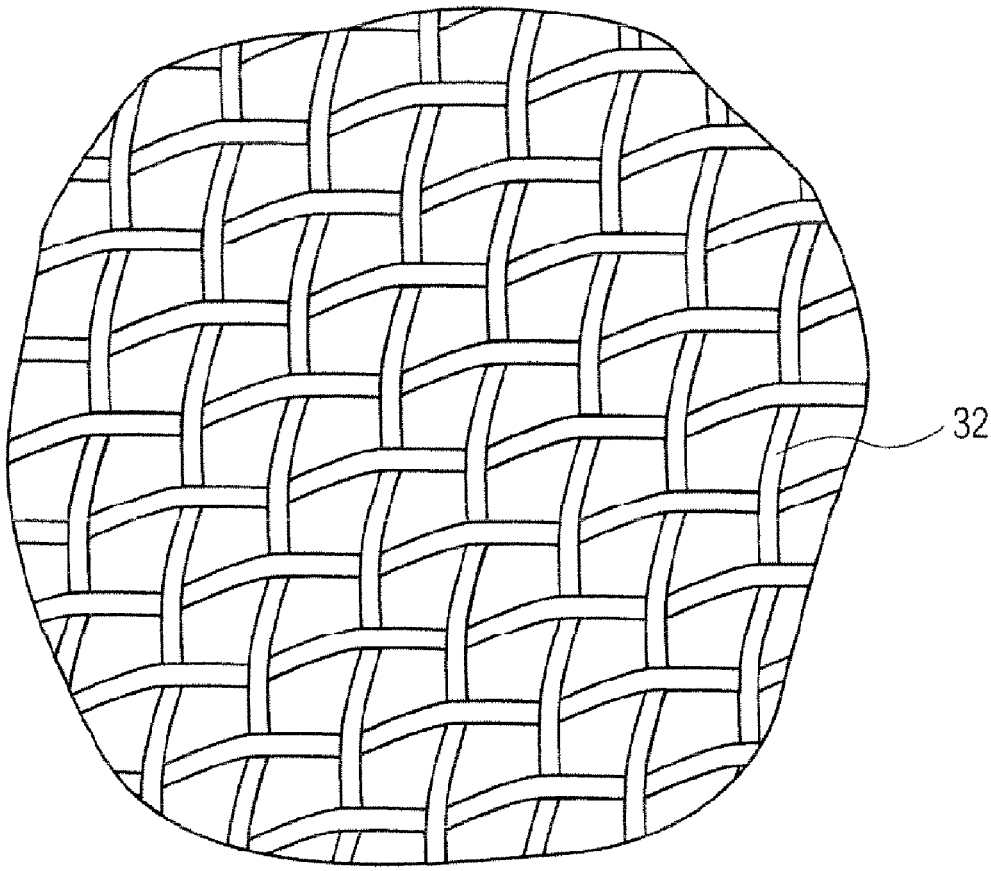
FIG. 7 is plan view of a portion of woven wire cloth which may form an innermost layer.

In the alternative, the inner layer 22 (and also the outer layer 12, FIG. 2, may be formed from woven wire cloth of the same wire as the knitted wire described above. An example of woven wire cloth is shown in FIG. 7. Here stainless steel wire 32 in this embodiment is woven in interleaved relationship as typical in woven structures. This is different than the knitted mesh configuration of FIG. 5 wherein the wire is formed into loops which are interconnected. In the woven style of FIG. 7, the wires are substantially linear except for the fact that they weave over and under each other alternatively in a rectilinear network of wires as shown. The weave forms substantially square openings between the weaves. Either knitted or woven wires thus may be used for the innermost layer 22. The outmost layer 12 is only knitted wire mesh. The type of weave of the inner layer is not important. However, the outer layer should be knitted wire mesh.

What is important is that the inner layer 22, which is tubular, is formed initially and stored for later use as noted above. This layer is solely wire mesh and no non-metal fibers are used in this layer.

The intermediate tubular layers 14, 16, 18 and 20, FIG. 2, are formed on a separate larger circular knitting machine or a weaving machine (not shown). These layers in this embodiment comprise stainless steel wire, for example, from about 0.003 inches to about 0.011 inches (about 0.076 mm to about 0.28 mm) diameter.

Figure 6:
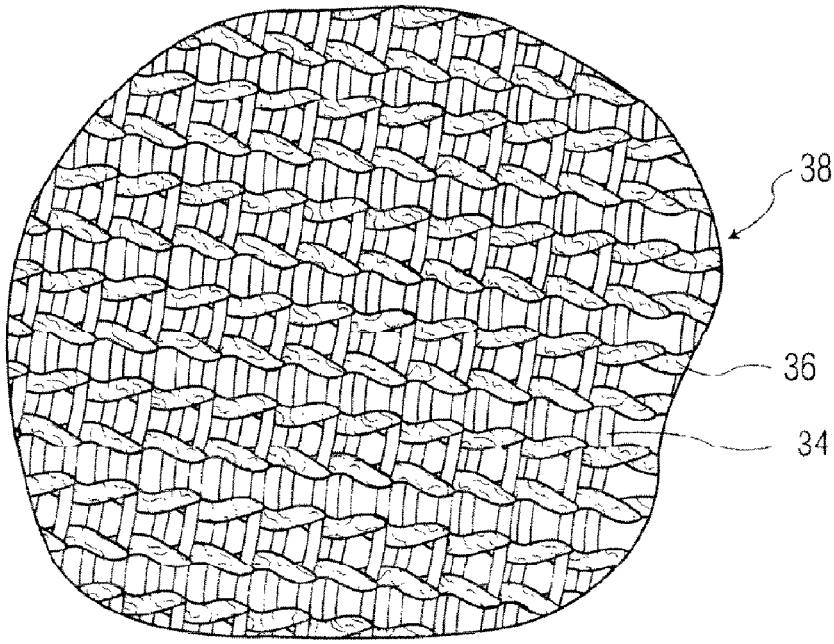
FIG. 6 is a plan view of a portion of the coknitted wire mesh and fiber forming the middle layer of the structure of FIG. 1.

Non-metallic fibers, and preferably basalt fibers, which are non-metallic, are coknitted with the knitted or woven wire to form a composite layer of material comprising knitted or woven wires interlaced with the non-metallic basalt fibers. These fibers are continuous in length and can withstand high temperatures such as at least 500° C. FIG. 6 illustrates woven substantially continuous length stainless steel wire 34 in this embodiment coknitted with substantially continuous length basalt fibers 36. This forms a sheet 38 of coknitted wire mesh and basalt fibers. The basalt fibers are preferably about 5 to about 20 microns in diameter. The fibers are assembled into a roving of about 330 bundle tex (g/1000 meters). The roving is then knitted with the wire to form the sheet 38.

While basalt fibers are used in one embodiment, any non-metallic fibers such as glass, carbon or ceramic and the like as known may be used in alternative embodiments according to a given implementation.

Basalt fibers are made from basalt rocks using a single component raw material in a single stage process. The fibers are formed as continuous fibers and later may be converted in a form for their intended use. A basalt roving is produced by assembling a bundle of strands into a single large strand, which is then wound into a stable, cylindrical package. The basalt fiber yarns are covered with a sizing agent as commercially available to provide sufficient integrity required for further processing. The fibers may also be formed into twisted yarn by twisting the roving. The twist provides additional integrity to the yarn prior to weaving.

The basalt fibers have relatively higher operating temperature, higher Young's modulus and greater chemical resistance as compared to fiberglass. Basalt fibers may replace asbestos and carbon fibers due to the basalt properties in comparison to these other fibers. However, any fiber may be used in the sleeve according to other various embodiments.

For example, the properties of basalt fibers of 9 micron diameter include a break tenacity of 35-40 (cN/tex), a density of 2.65 g/cm$^3$, a linear density of 50 tex and moisture recovery of 1.0% having a sizing agent content of 1-2%. The roving has a linear density of about 330+/−10% tex and a breaking load of about 107 N. Basalt fibers are available from Albarrie Canada Limited, Barrie, Ontario, Canada.

Figure 7A:
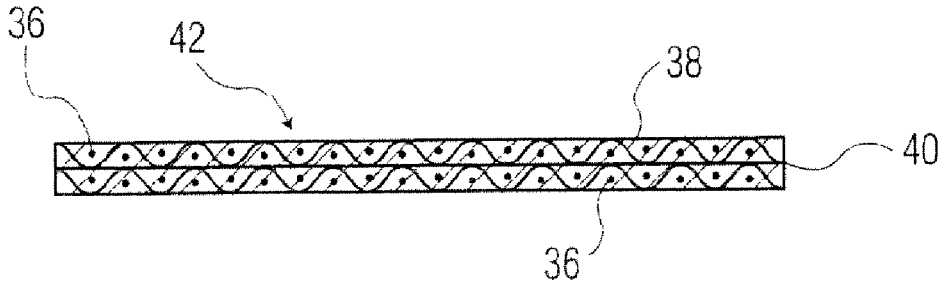

The coknitted basalt fibers and wire mesh are woven as a tubular structure and then flattened to form sheet 38, FIG. 6. In FIG. 7*a*, the flattened sheet 38 is then folded over at fold 40 to form a two layer structure 42 of two juxtaposed layers of coknitted wire and continuous length basalt fibers.

In FIG. 8, the inner tubular layer 22 and the folded over intermediate layer structure 42, in one embodiment, are fed into the larger mouth of a sheet metal cone 44. The cone wraps the intermediate layer structure about the inner layer 22 as they are fed through the cone. The structure 42 has a width sufficient so that it wraps twice about the inner tubular layer 22. The resulting layered tubular structure 46 exiting the cone 44 is fed into a circular knitting machine 48 via a cylindrical sheet metal guide band 50. The machine 48 pulls the inner tubular structure and the overlying intermediate multiple layers of wire mesh and coknitted fibers through the cone. Machine 48 knits the outer wire mesh layer 12, FIG. 2, at this time over these other inner layers. The outer mesh layer 12 is solely wire with no non-metallic fibers. The resulting tubular structure has any desired length as it is produced as a relatively continuous unlimited length tubular composite layered structure.

Figure 3:
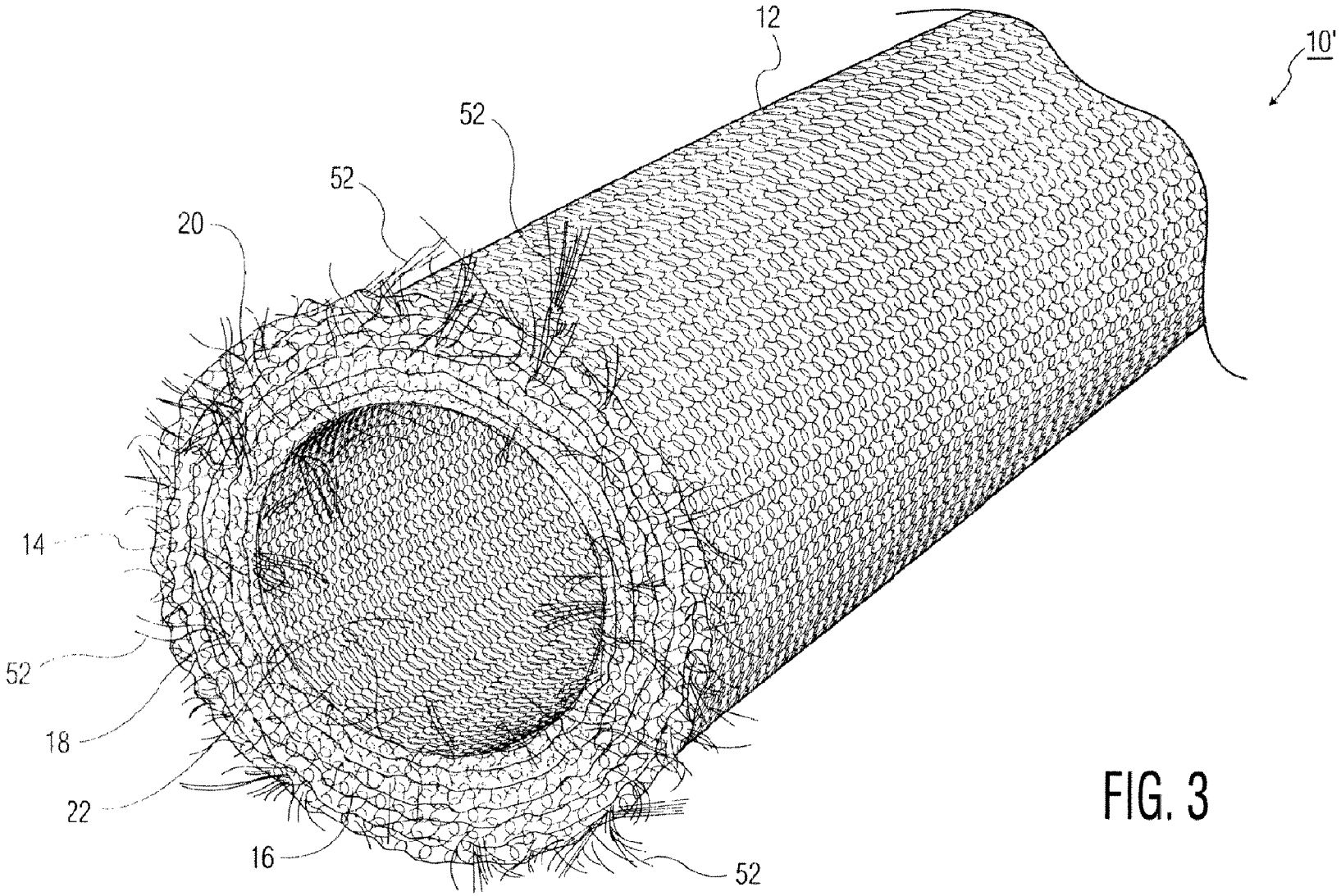
FIG. 3 is a perspective view of the sleeve of FIG. 1 with the ends unfinished.

The resulting structure of a continuous tubular structure of the inner, outer and intermediate layers are then drawn through a series of dies to reshape and form the final internal and external diameters of the tubular structure. This structure is then cut to length as shown in FIG. 3. In FIG. 3, the frayed ends 52 of the fibers are trimmed as necessary.

It will occur to one of ordinary skill that modifications may be made to the disclosed embodiments. For example, the fibers may be glass or other material that is resistant to high temperature environments. While the intermediate layer is preferably flattened into two overlying layers and then wrapped twice about the inner layer, this is exemplary.

The number of coknitted layers is optional and may comprise any number of layers according to a given implementation and may be fewer or more than the four disclosed layers of the disclosed embodiment. What is important is that the intermediate layer serves as a heat or sound insulation for a given application. Depending on the temperatures or sound intensities involved, more or fewer layers of the coknitted mesh may be used than the disclosed four overlying intermediate layers. The fibers may also comprise cotton, plastic, nylon, polyester or any other elongated strands of filaments wound on a spool for example.

While the application for the sleeve described herein in the disclosed embodiments is for a muffler packing, it will occur to those of ordinary skill that such a sleeve may be used for other applications wherein sound or heat insulation for a tubular member is needed. It is intended that the scope of the invention be defined by the appended claims, the description herein being given by way of illustration and not limitation.

What is claimed is:

1. A sleeve for sound/heat insulation for tubular members comprising:

a tubular knitted wire mesh outer layer comprising solely knitted wire;

a tubular knitted wire cloth inner layer comprising solely knitted wire; and at least one tubular intermediate layer between the outer and inner layers comprising knitted wire coknitted with at least one continuous fiber, the layers forming a concentric multilayered tubular structure.

2. The sleeve of claim 1 wherein the intermediate layer comprises a plurality of overlying layers of said knitted wire coknitted with said at least one continuous fiber.

3. The sleeve of claim 1 wherein the intermediate layer is wrapped at least once about the inner layer.

4. The sleeve of claim 1 wherein the inner layer comprises stainless steel wire in the range of about 0.011 to about 0.028 inches in diameter.

5. The sleeve of claim 1 wherein the outer layer comprises stainless steel wire in the range of about 0.006 to about 0.020 inches in diameter.

6. The sleeve of claim 1 wherein the intermediate layer comprises stainless steel wire in the range of about 0.003 to about 0.011 inches in diameter.

7. The sleeve of claim 1 wherein the at least one continuous fiber comprises basalt fibers having a diameter of about 5 to about 20 microns.

8. The sleeve of claim 1 wherein the fibers are basalt fibers which are assembled in a roving of about 330+/−10% bundle tex.

9. The sleeve of claim 1 wherein the inner layer is tubular with an inner diameter of about 0.5 to about 8 inches.

10. The sleeve of claim 1 wherein the at least one continuous fiber is non-metallic yarn which is resistant to relatively high temperatures of over about 500° C.

11. The sleeve of claim 1 wherein the knitted wire is stainless steel and the wires of the outer and inner layers are of different diameters.

12. A method of making a sound/heat insulating tubular structure comprising knitting a first cylindrical tubular wire mesh structure from metal wire to form a first layer, knitting a second cylindrical wire mesh tubular structure with metal wire coknitted with at least one continuous non-metallic fiber, flattening the second cylindrical tubular structure to form a coknitted metal wire structure with at least one continuous non-metallic fiber, wrapping the flattened second structure at least once about the first cylindrical structure to form a composite multilayered tubular structure and then knitting solely from metal wire a third outermost tubular layer about the composite multilayered tubular structure to continuously form a length of multiple layers of a tubular structure wherein the wrapped flattened second structure is intermediate the first and third layers, which are substantially concentric with each other.

13. The method of claim 12 including wrapping the flattened structure twice about the inner layer.

14. The method of claim 12 wherein the at least one continuous non-metallic fiber is basalt.

15. The method of claim 12 wherein the wrapping step includes feeding the first tubular structure and flattened second structure into a cone with the flattened second structure wrapped at least once about the first structure during the feeding into the cone.

16. The method of claim 12 including feeding all of the formed layers into a series of dies to reshape and form the internal diameter of the inner most first tubular layer and form the outer diameter of the outermost third tubular layer.

17. The method of claim 12 including forming the second structure into at least two flattened layers and then wrapping the second structure twice about the inner tubular structure to form a five layer structure such that the knitted outer layer forms the sound/heat insulating tubular structure into a six layer structure.

18. The method of claim 17 including knitting all of the wire meshes with stainless steel wire.

19. The method of claim 12 including knitting the inner layer of wire having a diameter that is larger than the diameter of the wire of the intermediate layer and knitting the intermediate layer of wire having a diameter that is smaller than the diameter of the third outermost layer.

20. The method of claim 12 wherein the method includes periodically severing the length into finite length tubular structures.

21. An internal combustion engine exhaust muffler packing sleeve for providing sound or heat insulation for the muffler comprising:

a knitted wire mesh outer tubular layer comprising solely knitted wire;

a knitted wire mesh inner tubular layer concentric with the outer layer and comprising solely knitted wire; and a plurality of intermediate tubular layers between and concentric with the outer and inner layers comprising knitted wire coknitted with at least one continuous length non-metallic fiber to form a plurality of composite knitted wire mesh-knitted non-metallic fiber layers.

22. The sleeve of claim 21 wherein the coknitted layer comprises two overlying contiguous layers disposed between the inner and outer layers.

23. The sleeve of claim 22 wherein the two layers are first formed in an intermediate stage as two planar overlying layers and then wrapped and bent about the inner layer at least once to form two overlying tubular layers of coknitted wire and non-metallic fiber mesh.

* * * * *